United States Patent [19]

Sanville

[11] 4,256,278

[45] Mar. 17, 1981

[54] RAILWAY FREIGHT CAR IDENTIFICATION SYSTEM

[75] Inventor: W. Woodward Sanville, Brentwood, N.Y.

[73] Assignee: Servo Corporation of America, Hicksville, N.Y.

[21] Appl. No.: 59,623

[22] Filed: Jul. 23, 1979

[51] Int. Cl.[3] ..... B61L 25/04

[52] U.S. Cl. ..... 246/247; 235/92 TC; 246/169 D

[58] Field of Search ..... 246/169 A, 169 D, 169 R, 246/169 S, 247, 249, 77, 1 R, 122 R, 182 AA, 182 AB, 255; 116/DIG. 38; 340/682; 364/562, 561; 235/92 TC

[56] References Cited

U.S. PATENT DOCUMENTS

| | | | |
|---|---|---|---|
| 2,963,575 | 12/1960 | Pelino et al. | 340/682 X |
| 3,573,441 | 4/1971 | Glazar | 246/1 R X |
| 3,812,343 | 5/1974 | Gallagher et al. | 246/169 D |

FOREIGN PATENT DOCUMENTS

| | | | |
|---|---|---|---|
| 216781 | 7/1968 | U.S.S.R. | 246/247 |

*Primary Examiner*—J. D. Miller
*Assistant Examiner*—Reinhard J. Eisenzopf

[57] ABSTRACT

A system is provided for determining whether a railway car passing a sensing station is a freight car. The system utilizes wheel trips along the track at the sensing station to determine the spacing between axles of the car. If the spacing between axles is determined to fall between slightly more than 4' - 5" to slightly less than 6' - 1" the car is presumed to be a freight car.

6 Claims, 2 Drawing Figures

RAILWAY FREIGHT CAR IDENTIFICATION SYSTEM

BACKGROUND OF THE INVENTION

The present invention relates to railway car overheated bearing detection systems and in particular to a system for determining if a railway car under observation is a "freight" car.

A major cause of train derailment is the overheating of the wheel bearings, commonly known as "hot boxes". Railroads often utilize infra-red scanner systems along their tracks to scan the bearings of passing trains and to generate an alarm in the event an overheated bearing is detected. Such a system may, for example, comprise the Hot Box Detective System marketed by the Servo Corporation of America of Hicksville, New York.

A problem with such infra-red systems arises from the fact that not all railway car axles have the same type of bearings and certain bearings inherently run hotter than other bearings. Specifically, roller bearings run at temperatures sufficiently high to be considered an overheated friction bearing. As a result, it has been necessary to provide discriminator circuits to determine whether a particular bearing under observation is a friction bearing or a roller bearing. Such discriminators may, for example, comprise the Universal Alarm System of the aforementioned Servo Corporation.

While the primary objective of hot box detector systems is to detect every hot box of passing trains, a secondary objective is to eliminate as many false alarms as possible. The unnecessary stopping of a railroad train is a very expensive and time wasting nuisance. A false alarm will be generated each time the discriminator circuit fails to recognize that a passing bearing is a normally operating roller bearing and instead treats it as an overheated friction bearing.

In North America, friction bearings are only used on freight cars while roller bearings may be used on freight cars as well as passenger cars and locomotives. Accordingly, if the determination can be made that the railway car passing an infrared sensor scanning station is not a freight car, then the discriminator circuit need not make the determination as to whether a passing bearing is a roller bearing or friction bearing since it is known that the bearings can only be roller bearings. On the other hand if the determination is made that a passing car is a freight car, then the further determination must be made as to whether roller bearings or friction bearings are under observation.

In view of the above, it is the principal object of the present invention to provide a system for the determination of whether a railway car passing a hot box scanning station is a freight car.

A further object is to provide such a system which may be implemented with conventional components and which is compatible with existing hot box detector systems and equipment.

SUMMARY OF THE INVENTION

The above and other beneficial objects and advantages are attained in accordance with the present invention by providing a system for detecting the spacing between adjacent axles along a railway car undercarriage truck. Since in North America, freight car axles are spaced between 4' - 6" and 6' - 0", while non freight car axles are well over six feet in virtually all cases, the detection of an axle spacing between 4'6" and 6' - 0" is utilized to identify the passing of a freight car. To this end, a first wheel trip is placed along a section of track upstream from second and third wheel trips which in turn are separated from each other by the allowable range for freight car axles (i.e., 6'0" minus 4'6"). If the first wheel of a passing car truck is detected within the range while the next wheel triggers the first wheel trip, a signal is generated indicative of a freight car being sensed. Conversely if the first wheel exits the range or does not enter the range prior to the next wheel triggering the first wheel trip, a signal is generated indicative of a car other than a freight car passing.

The present system is further provided with means for bidirectional operation as well as resetting after each determination and the passage of the train past the scanning station.

DETAILED DESCRIPTION OF THE PREFERRED EMBODIMENT

Figure 1:
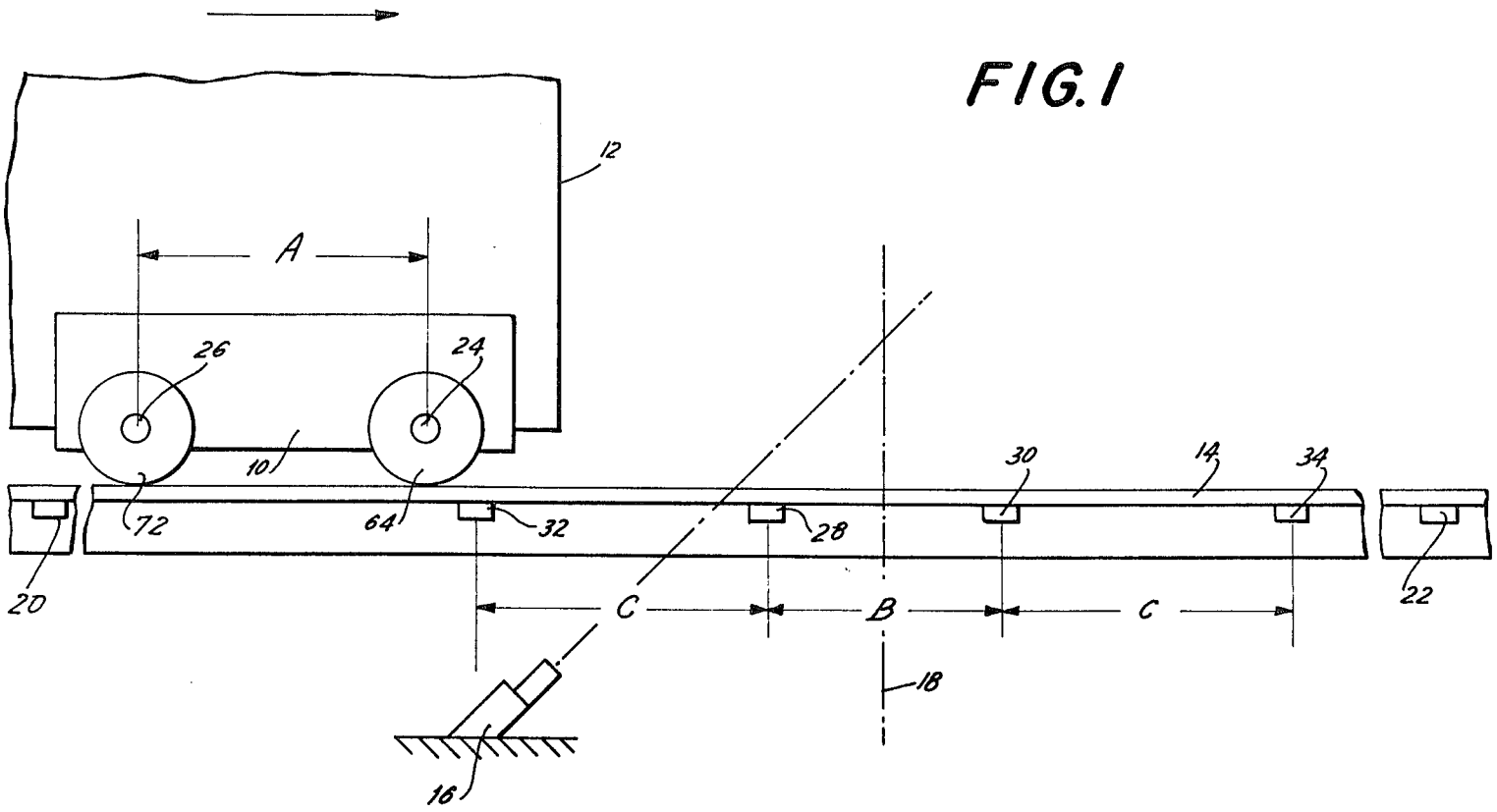
FIG. 1 is a simplified schematic drawing of a section of track provided with wheel trips in accordance with the present invention; and, FIG. 2 is a block diagram of the circuitry of the present invention.

Reference is now made to the drawings and to FIG. 1 in particular wherein a truck 10 of a railway freight car 12 is depicted on a length of track 14 extending past a hot box sensor 16. The details of sensor 16 are well known to those skilled in the art and comprise no part of the present invention. Scanning takes place along the vertical axis 18 by virtue of the placement and focusing of sensor 16.

A pair of wheel trips 20 and 22 are positioned along the track outboard of the scanning site. The wheel trips 20 and 22 (as well as the wheel trips to be described forthwith) are of conventional type and are commercially available from the Servo Corporation of America under the tradename SERVOTRIP®. Such wheel trips are designed so that when a wheel passes a particular point a signal is generated. In the present discussion, references to the wheel trip are directed to the operating points.

As stated, the present invention relies upon the observation that the spacing "A" between axles 24 and 26 of a freight car truck varies between 4' - 6" and 6' - 0", i.e., the variable range of axle separation for freight cars is 18". Accordingly, any detection of an axle spacing greater than 6' - 0" or less than 4' - 6" is treated by the present invention as not being a freight car.

In accordance with the present invention, a pair of wheel trips 28 and 30 are positioned on track 14 separated from each other by the distance "B" which is slightly greater than the variable axle range and centered about axis 18. Thus, in practice where the variable axle range is 18", the separation B may be 20". An additional wheel trip 32 is positioned uprail (assuming train traffic in the direction indicated by the arrow) from wheel trip 28 by a distance "C" slightly less than the minimum freight axle separation "A". In practice, where the minimum value for "A" is 4' - 6", an approximate value for "C" is 4' - 5" from wheel trip 28. A further wheel trip 34 may be provided downrail from wheel trip 30 by the distance "C". Wheel trip 34 is used in the event traffic along rail 14 is in either direction.

Figure 2:
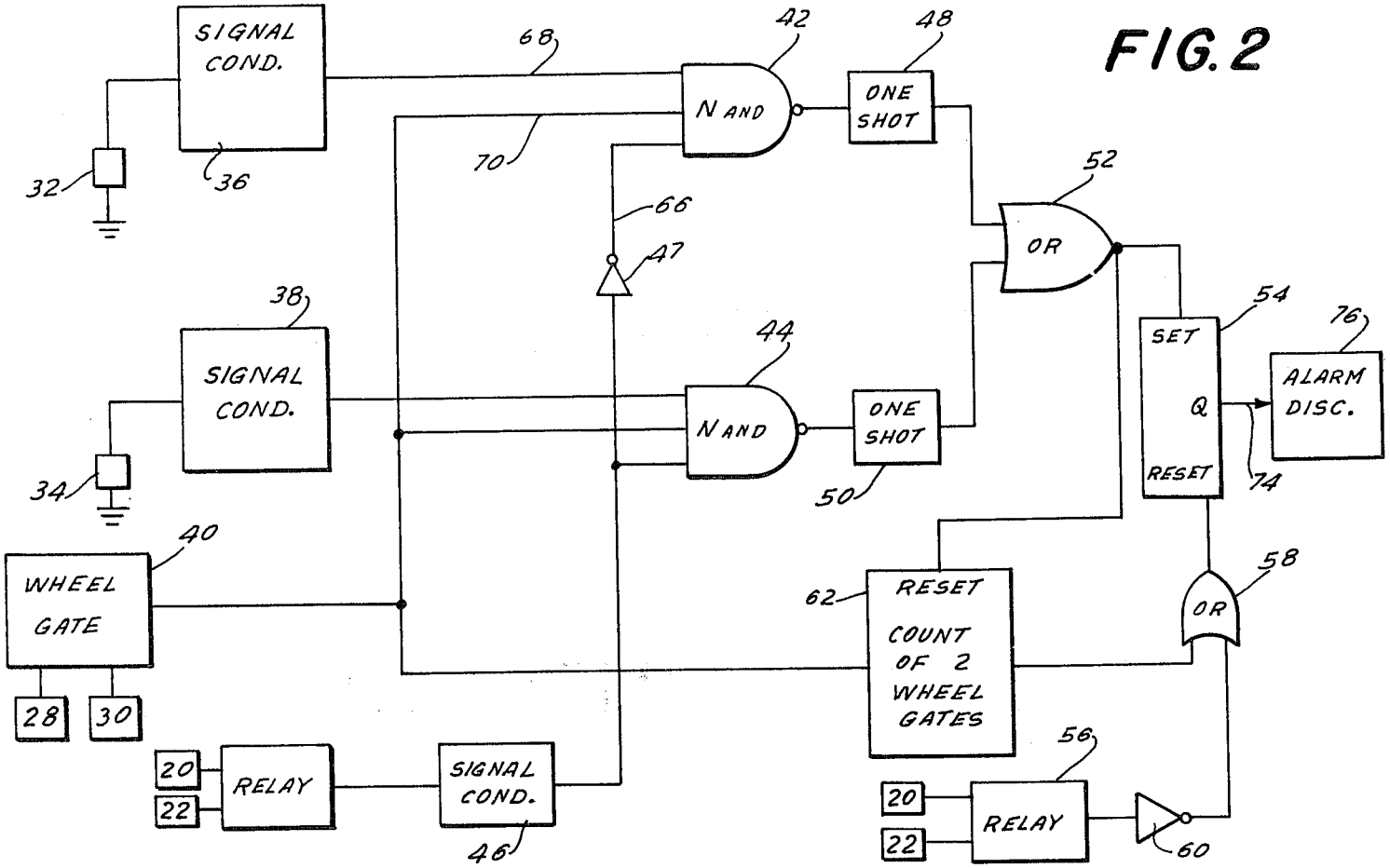

The circuit for processing the signals obtained from the various wheel trips and the sensor of FIG. 1 are depicted in FIG. 2. Accordingly, when wheel trip 32 is triggered, a signal is generated which is fed to signal conditioner 36 which in turn generates a logic level "1" output signal. Similarly when wheel trip 34 is triggered, a signal is generated which is fed to signal conditioner 38 to generate a logic level "1" output signal.

Wheel trips 28 and 30 are connected to wheel gate 40. Wheel gate 40 serves to generate a logic level "1" from the time wheel trip 28 is triggered until wheel trip 30 is triggered for a train traveling in the direction shown in FIG. 1 or from the time wheel trip 30 is triggered until wheel trip 28 is triggered for a train traveling in the opposite direction.

The output of wheel gate 40 along with the output of conditioner 36 are fed to NAND gate 42. Similarly the output of wheel gate 40 and signal conditioner 38 are fed to NAND gate 44. Additional inputs to gates 42 and 44 comprise outputs from signal conditioner 46 which is activated by wheels passing the outboard wheel trips 20 or 22 depending on the direction from which the train enters the sensing zone. Signal conditioner 46 generates a logic level "0" for train traffic in the direction indicated by the arrow and a logic "1" for traffic in the opposite direction. The output of signal conditioner 46 is applied to gate 44 and inverter 47 whose output is applied to gate 42. Thus train direction determines whether NAND 42 or 44 is selected.

The outputs of NAND gates 42 and 44 are fed to one shots 48 and 50 respectively. The one shots 48 and 50 in turn are connected to OR gate 52, the output of which is connected to the set terminal of flip flop 54.

Wheel trips 20 and 22 are also connected to a relay 56. As is common with hot box detector systems, relay 56 remains closed during the presence of a train between wheel trips 20 and 22 and opens when the last wheel of the last car of the train passes the downward wheel trip. The output of relay 56 is fed to OR gate 58 through inverter 60. The output of OR gate 58 is connected to the RESET terminal of flip flop 54.

An additional input to OR gate 58 is the output of counter 62 which counts to 2 the inputs it receives from wheel gate 40. Counter 62 resets upon receipt of an output from OR gate 52.

The operation of the present system will now be described wherein it is assumed that a train is traveling in the direction of the arrow of FIG. 1 when wheel trip 20 is passed by first wheel 64 of truck 10. For that direction inverter 47 has a logic level '1' output that enables gate 42. When wheel trip 32 is passed an input to gate 42 appears but is not held on line 68. The one shot 48 is not fired since gate 42 has no input on line 70. When wheel 72 passes wheel trip 32, gate 42 can trigger one shot 48 only if wheel 64 is between wheel trips 28 and 30 when wheel gate 40 is activated, so that signals appear simultaneously on each of lines 66, 68 and 70. This condition (of wheel 72 passing trip 32 when wheel 64 is between trips 28 and 30) can only occur if the spacing between axles 24 and 26 is between slightly more than "C" and slightly less than "C" & "B". If this condition occurs, the determination can be made that truck 10 has axles spaced between slightly more than 4' - 5" to slightly less than 6' - 1" and hence the car is a freight car and the bearings can be roller bearings or friction bearings. Thus, the output 74 of flip flop 54 is generated to activate a bearing discriminator circuit 76 such as that available from the Servo Corporation. If the first wheel 64 had failed to reach trip 28 or passed trip 30 before wheel 72 passed over trip 32, the distance between axles would have to be less than 4' - 5" or greater than 6" - 1" and hence the car is not a freight car and the bearings *must* be of the roller type so that the bearing discriminator circuit 76 is not needed.

Flip flop 54 remains set until reset by counter 62 counting two axles passing between trips 28 and 30 or the end of the train is detected. Thus, each time a determination is made for an axle of a truck, it is also made for the next axle. After each set of axles passes, a new determination of a passing freight car truck must be made because flip flop 54 would be reset by counter 62. If the train had been traveling in the direction opposite to that shown, flip flop 54 would have been activated by one shot 50.

Thus, in accordance with the above, the aforementioned objectives may be effectively attained.

What is claimed:

1. A system for determining if a railway car passing a sensing station along a length of track is a freight car, said system comprising:

a first transducer adapted to detect the passing of a wheel at a first location along said track;

a second transducer at a second location along said track spaced downrail from said first location by a distance slightly less than the minimum spacing between axles of a freight car truck;

a third transducer at a third location along said track spaced downrail from said first location by a distance slightly greater than the maximum spacing between axles of a freight car truck; and means for determining if a first wheel of a railway car passing from said first location toward said second location is between said second and third transducers when a second wheel of said car passes said first transducer.

2. The system in accordance with claim 1 further comprising a fourth transducer at a fourth location spaced downrail from said third location by a distance slightly less than the minimum spacing between axles of a freight car truck; and means for determining if a first wheel of a railway car passing from said fourth location toward said third location is between said second and third transducers when a second wheel passes said fourth transducer.

3. The system in accordance with claim 2 further comprising means for detecting the end of said passing car, said end detecting means being operatively connected to reset said flip flop.

4. The system in accordance with claims 1 or 2 wherein said determining means includes a flip flop and means for setting said flip flop when a first wheel of a passing railway car is between said second and third transducers when a second wheel of said car passes said first transducer.

5. The system in accordance with claim 4 further comprising counting means adapted to reset said flip flop after the setting of said flip flop and two wheels pass between said second and third transducers.

6. The system in accordance with claim 1 or 2 further comprising means for determining the direction of travel of a railway train past said sensing station.

* * * * *